United States Patent [19]

Fagen, Jr. et al.

[11] Patent Number: 4,524,088

[45] Date of Patent: Jun. 18, 1985

[54] METHOD AND APPARATUS FOR CONTROLLING THE THICKNESS OF DEVELOPER ON AN APPLICATOR, SUCH AS A MAGNETIC BRUSH, IN ELECTROSTATIC REPRODUCTION

[75] Inventors: Ben W. Fagen, Jr.; Douglas W. Cappon, both of Rochester, N.Y.

[73] Assignee: Magnetic Technologies Corp., Rochester, N.Y.

[21] Appl. No.: 462,651

[22] Filed: Jan. 31, 1983

[51] Int. Cl.[3] ..... B05D 5/12; G03G 15/00

[52] U.S. Cl. ..... 427/10; 427/127; 118/688; 118/712; 222/DIG. 1; 355/14 D

[58] Field of Search ..... 355/14 D; 324/455, 452, 324/457, 458; 427/10, 127, 199; 118/688, 712; 222/52, DIG. 1; 430/107, 120, 903

[56] References Cited

U.S. PATENT DOCUMENTS

| | | | |
|---|---|---|---|
| 3,376,853 | 4/1968 | Weiler et al. | 118/637 |
| 3,674,353 | 7/1972 | Trachtenberg | 355/3 |
| 3,779,203 | 12/1973 | Altmann | 118/637 X |
| 3,788,739 | 1/1974 | Coriale | 355/17 |
| 3,802,381 | 4/1974 | O'Neill et al. | 118/637 X |
| 3,821,938 | 7/1974 | Bacon et al. | 118/637 X |
| 3,910,459 | 10/1975 | Buck et al. | 222/56 |
| 3,970,036 | 7/1976 | Baer et al. | 118/637 X |
| 4,133,453 | 9/1979 | Ohbora | 222/39 |
| 4,270,487 | 6/1981 | Terashima et al. | 118/690 |
| 4,321,886 | 3/1982 | Azuma | 118/689 |
| 4,343,548 | 8/1982 | Bores et al. | 355/3 DD |
| 4,357,901 | 11/1982 | Fagen, Jr. et al. | 118/689 |
| 4,365,894 | 12/1982 | Nakamura | 355/77 |

FOREIGN PATENT DOCUMENTS

WO80/02600 11/1980 PCT Int'l Appl. .

*Primary Examiner*—Norman Morganstern
*Assistant Examiner*—Ken Jaconetty
*Attorney, Agent, or Firm*—Martin LuKacher

[57] ABSTRACT

A magnetic brush developing system for electrostatic duplication using a monocomponent developer controls the thickness of the developer on the brush such that the necessary amount of developer is applied to the photosensitive surface which carries the latent electrostatic image. A capacitive sensor in the form of a rigid plate of conductive material is spaced closely adjacent to the surface of the roll on which the magnetic brush is formed. The dielectric constant depends on the thickness of the developer in the magnetic brush and is detected by the capacitive sensor. The capacitance of the sensor is converted, into a pulse train the duty cycle of which is modulated in accordance with the change in capacitance, by a circuit arranged on a circuit board in close proximity to the sensor to provide a compact structure which is not subject to perturbations which could effect the capacitance presented by the sensor. The circuit controls the supply of developer to the brush in response to the duty cycle of the pulse train by causing the dispensing of the developer when a duty cycle change corresponding to the decrease in the thickness of the developer in the brush occurs and terminating the dispensing of the developer when the thickness becomes excessive thereby providing a layer of developer of consistent thickness in the brush so that copies of desirable optical density are obtained.

24 Claims, 3 Drawing Figures

ON/OFF
MOTOR CONTROL
24
22
20
w
z
16
18
x
26
d
h
28
12
14
y
u

28
GND
TRG
OUT
RST
TIMER (OSC)
+V
DCH
THR
CV
29
30
32
T
T
33
39
$T_{C1}$
$T_{C2}$
GND
TRG
OUT
RST
TIMER (DCM)
+V
DCH
THR
CV
34
36
37
35
x
$V_C$
w
55
z
42
40
44
y
45
49
52
54
47
46
48
50
LED
u

METHOD AND APPARATUS FOR CONTROLLING THE THICKNESS OF DEVELOPER ON AN APPLICATOR, SUCH AS A MAGNETIC BRUSH, IN ELECTROSTATIC REPRODUCTION

DESCRIPTION

The present invention relates to methods and apparatus for controlling the thickness of the developer on an applicator, such as a magnetic brush, in the developer unit of an electrostatic or xerographic copier.

The present invention is especially adapted for use in developer systems employing monocomponent developers where the toner and the carrier are in the form of unitary particles which are transferred to the photoreceptor and then to the substrate on which the copy is made; being used up in the reproduction process. The monocomponent developer, like the two component (magnetic carrier and nonmagnetic toner powder) developer must be applied in an amount consistent with the usage thereof in order to obtain copies of desirable optical density. In the two component developer systems, the concentration of the toner component as well as the rate of transfer of the toner component to the electrostatic image may be determined and additional toner added to the carrier component in a sump which supplies the two component developer to the magnetic brush applicator. Further information concerning such a toner concentration control system may be obtained from U.S. Pat. No. 4,357,901 issued Nov. 9, 1982 to Ben W. Fagen, Jr., et al. The availability of a sump from which the developer is obtained by the magnetic brush and the large size of the dual component particles (for example, from 50 to 200 microns) insures that the thickness of the layer of developer material in the magnetic brush will be sufficient to apply the developer to the photoreceptor (the belt or brush) on which the latent electrostatic image is formed. With monocomponent developers, however, the particles of the developer are very much smaller than the dual component developers (for example, from 5 to 20 microns in particle size). The thickness of the layer of developer material in the magnetic brush formed by these particles is considerably smaller than for the dual component developers. The problem of forming a brush of proper and consistent thickness to prevent voids in the image which is reproduced in the electrostatic or xerographic process is further exacerbated by the absence of a sump for retaining a large supply of developer due to space and cost restraints in the compact copiers of minimum complexity with which monocomponent developers are adapted for use.

It has been proposed merely to insure that there is sufficient developer in a hopper from which the developer drops on the brush by gravity (see, U.S. Pat. No. 4,270,487 issued June 2, 1981). There is no assurance, however, that the thickness of the developer layer in the brush is consistent; nor is there any actual control over the amount of developer which is supplied to the brush. The possibility of using a capacitive sensor has presented itself. However, the minute variations in capacitance which may range from 5 to 10 picofarads has militated against the use of capacitive sensors. Moreover, the environment of the developer system is subject to mechanical vibrations, changes in positions and dimensions due to temperature affects, and other transient perturbations which may affect capacitive sensing.

It is a feature of the present invention to provide an improved method and apparatus for controlling the application of a developer, even a monocomponent developer, such that copies of desirable optical density are obtained and voids in the electrostatically or xerographically reproduced image are prevented.

Another feature of the invention is to control the application of the developer by maintaining the layer thereof from which the developer is applied to the photoreceptor of consistent thickness, even with varying usage of the developer.

It is a still further feature of the invention to provide an improved method and apparatus for developing electrostatic or xerographic images in which a capacitive sensor is used and with which consistent thickness of the developer, as in the magnetic brush, is maintained in spite of very small changes in capacitance with changes in thickness of the layer and in an environment of rotating gears and shafts and temperature perturbations.

Briefly described, a developer system for applying developer material to a photoreceptor to develop an electrostatic image thereon which embodies the method and apparatus of the invention, controls the thickness of developer material which may be a monocomponent developer, on a magnetic brush which transfers the developer material to the photoreceptor. The thickness is sensed by sensing the dielectric constant presented by the amount of developer material in a region adjacent to the brush. A bar of conductive material, which is stiff and rigid so as to be substantially immune to aperiodic vibration, is preferably disposed out of contact with the surface of the roll or cylinder on which the layer of developer material is formed into the brush. The capacitance between the bar and the roll is proportional to the dielectric constant of the developer material in the layer in accordance with the formula, $C=e_0 K_d a/d$, where C is the capacitance presented by the sensor. d is the distance between the opposing surfaces of the sensor and the cylinder or roll of the magnetic brush, $e_0$ is the permitivity of free space, a is the area of the bar (the plate area of the capacitor), and $K_d$ is the dielectric constant which depends on the amount of the developer material in the region. The capacitance change in a developer unit for a compact copier may be in the order of picofarads. Nevertheless, this capacitance change provides a control voltage suitable for controlling the dispensing of the developer material by converting the capacitance change into a repetitive pulse train, the duty cycle of which varies in accordance with the capacitance presented by the sensor, including the bar. In a preferred embodiment this duty cycle modulated pulse train is obtained with timer circuits, one of which provides a repetitive pulse train and is used to synchronize the other time circuit, which operates as a monostable circuit controlled by the capacitance of the sensor. The circuitry may be mounted on a circuit board in the immediate proximity of the bar which provides the sensor and rigidly secured in the same frame with the magnetic brush and the capacitance sensor bar. The structural arrangement and the duty cycle modulation of the pulse train, which may be of such a frequency as not to be perturbed by aperiodic vibrations, provides accurate control of the thickness of the developer for maintaining a consistent thickness which affords uniform application of the developer material to the electrostatic image for the development thereof with desirable optical density and without voids.

The foregoing and other objects, features and advantages of the invention as well as a presently preferred embodiment thereof, will be more apparent from a reading of the following description in connection with the accompanying drawings in which.

Figure 1:
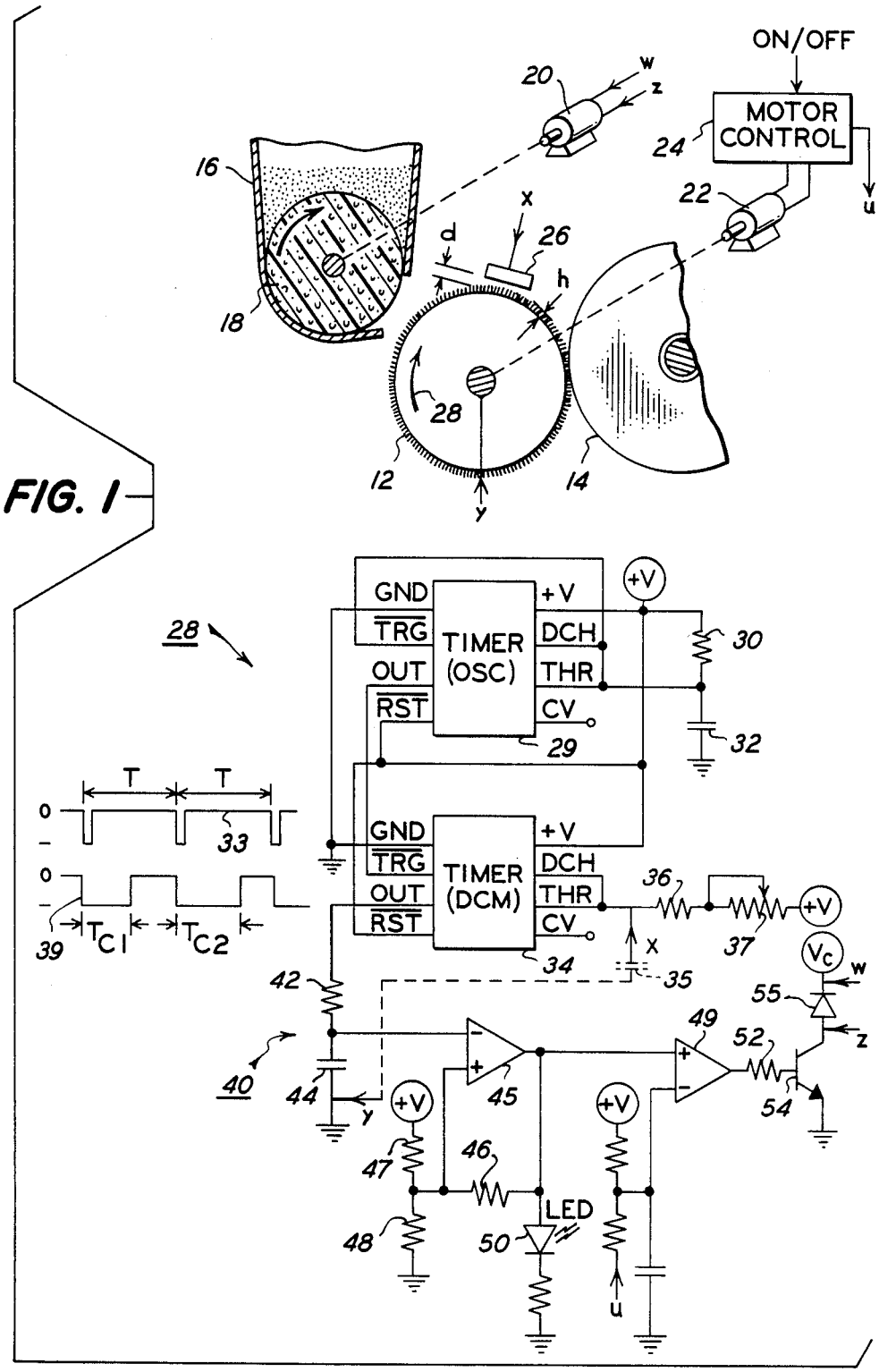
FIG. 1 is a schematic diagram of developer apparatus especially adapted for use with a monocomponent developer material and which embodies the invention.

Referring more particularly to FIG. 1, there is shown a developer system 10, a principal component of which is a magnetic brush 12 which applies the developer to a photoreceptor 14. The photoreceptor is shown as a drum on which the latent electrostatic image is applied. The developer is a monocomponent developer of the type which is available commercially. It consists of a small particle of magnetic material, usually iron or iron oxide, coated by the toner component which may be carbon black in a plastic binder. The developer consisting of these particles is supplied to the magnetic brush from a hopper 16. The dispensing of the developer from the hopper is carried out by a valve or applicator, preferably a sponge roller 18. This sponge roller is rotated by an actuator 20 which may be a direct current (DC) motor. The applicator roller 18 is turned when additional developer is required to be supplied to the magnetic brush 12. Other means for motivating or actuating the dispensing applicator 18 may be used, for example, a stepping motor, or a solenoid operated ratchet mechanism. The developer adheres to the magnetic brush as a layer on the periphery of the cylinder which defines the outside or shell of the brush. The inside of the brush consists of an array of magnets. Either the cylinder or the magnet array may rotate. In this embodiment of the invention, the magnet array is rotated by a motor 22. The shaft on which the magnet array is mounted is connected to the motor and rotated continuously during the operation of the copier. Motor operation is controlled, as by an on-off command line via a motor control 24. An output indicated as, u, is obtained indicating whether the motor is on and the magnetic brush is rotated or the motor is off and the magnetic brush is stationary. The magnetic brush travels in the direction indicated by the arrow 28 and the developer is carried between the supply 16 and the photoreceptor 14. The photoreceptor is also rotated as is conventional in electrostatic duplicators.

Figure 2:
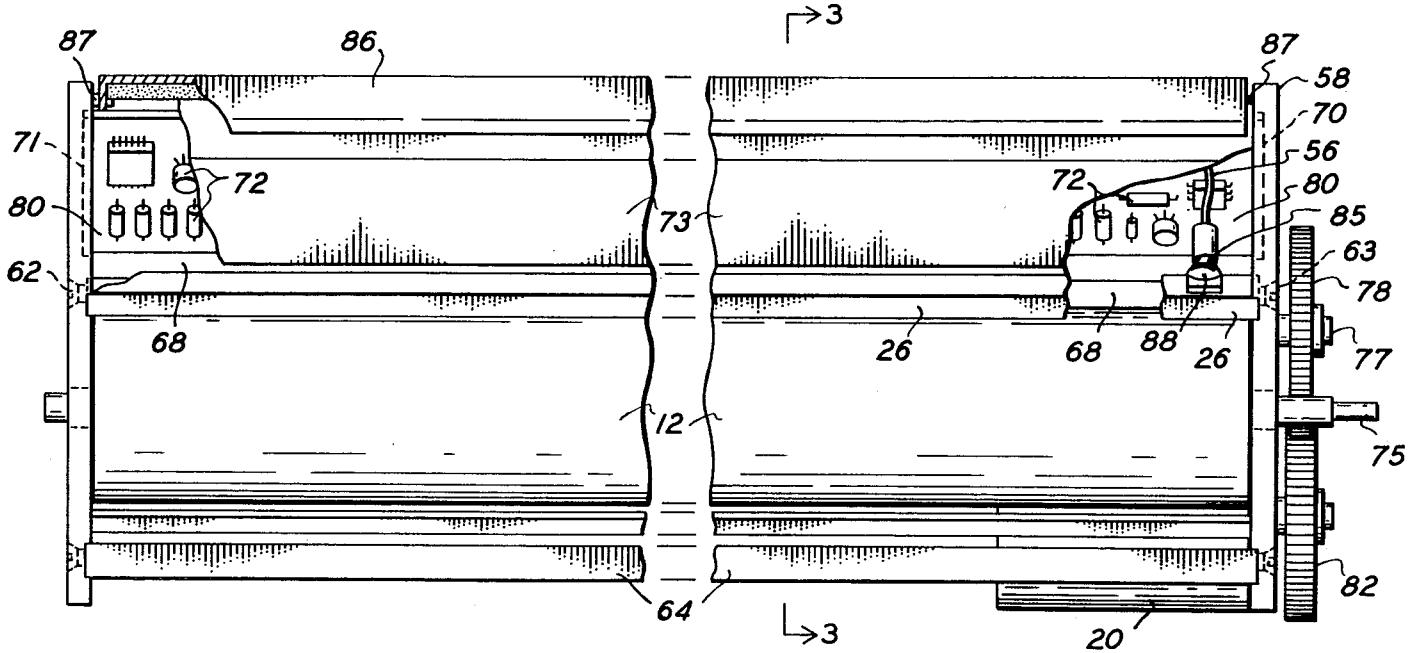
FIG. 2 is a view in elevation showing the structure of the developer apparatus which is illustrated in FIG. 1 in greater details.

The magnetic brush, thus, provides a carrier for the developer on the surface thereof. The thickness of the layer of developer will vary between peaks and troughs along the periphery of the brush. The location of these peaks and troughs depends upon the location of the magnets in the magnetic array. It is desirable that the peaks, which constitute the tips of the brush, contact the surface of the photoreceptor 14 so as to apply a uniform layer of developer thereon. Inasmuch as the height of the brush to the tips, indicated by the distance h is very small and may be less than 1/10 inch, it is important that the thickness of the layer be monitored and maintained to a high degree of accuracy. This is carried out by sensing the dielectric constant in a region along which the brush travels between the supplying station provided by the hopper 16 and sponge roller 18 and the transfer point for the developer at the photoreceptor 14. The region is defined by a bar 26 which is spaced from the surface of the carrier 12 (the magnetic brush) by a distance, indicated as d, which is sufficient to maintain the bar out of contact with the layer of developer of the magnetic brush 12. The bar 26 is desirably a stiff and rigid bar so as to be substantially immune from effects which may vary the distance d. The distance, d, may, for example, be approximately 0.125 inch so as to assure that the surface of the bar 26 will be maintained out of contact with the layer of developer on the brush 12. While the bar is shown as a rectangular bar, it may be curved complementary to the curvature of the surface of the brush on which the layer of developer is disposed. The rectangular structure of the bar is preferred since it facilitates the mounting thereof in the developer structure, as will be apparent from FIGS. 2 and 3 below, and also reduces the cost of the system. The material of the bar 26 may be any conductive material; aluminum being suitable. The bar preferably extends parallel to the axis of the brush and is of a length commensurate with the length of the carrier cylinder of the brush 12. There is, therefore, an area in the region which determines, in part, the capacitance which is detected or sensed by the capacitive sensor constituted by the bar and the surface of the brush. The surface of the roll or cylinder providing brush provides one plate of the capacitor and a connection thereto is obtained via the lead indicated at the letter y. The connection to the other plate, which is provided by the bar 26, is obtained by the lead which is connected thereto at the terminal indicated by the letter x. The area of the plates of the capacitor as well as the dielectric constant in the region defined by these plates determines the capacitance which is sensed as will be apparent from the formula for capacitance given above. The variation in this capacitance is very small, for example, 5 to 10 picofarads within a background capacitance of 50 picofarads in a typical compact developer for a compact electrostatic duplicator where the magnetic roll and bar are approximately 250 mm long and the bar is approximately 12 mm wide. In accordance with the capacitance which is sensed and appears between the terminals x and y, the roller sponge, applicator 18 is actuated by applying operating voltage to the motor 20 which rotates the roller 18 at the terminals of the motor indicated at w and z. As the roller 18 turns, the sponge material thereof picks up the developer and delivers it to the opening in the hopper. The magnet array attracts the developer presented at the surface of the roller 18. So long as the roller 18 is rotated, additional developer is dispensed on to the magnetic brush. When the motor stops the supply of developer is terminated. Accordingly, by turning the motor 20 on and off, the amount of developer can be controlled in accordance with the capacitance presented by the capacitive sensor provided by bar 26 and the opposing surface of the magnetic brush thereto.

The developer system 10 also includes the circuitry 28 which is connected to the terminals x, y, w, z and u as indicated by the letters x, y, w, z and u at the connections to different points in the circuitry. The circuitry develops a train of pulses which are repetitive at a fixed frequency, and the duty cycle of which varies in accordance with the capacitance which is detected by the capacitive sensor including the bar 26. By virtue of the change of the capacitance into an electrical signal of varying duty cycle, the extremely small capacitance change may be used to develop an electrical signal of significant magnitude which may readily be used to control the supply of the developer by turning the motor 20 on and off.

The circuitry which develops the variable duty cycle pulse train is provided by first and second pulse train generators. The first pulse train generator and the second pulse train generator may be provided by identical integrated circuits. In a preferred embodiment of the invention these are RC timers of the type generally known as 555. A suitable timer of this type is the ICM7555 which is available commercially from the Intersil Company. The timers have a plurality of inputs and outputs which are shown as the discharge (DCH), threshold (THR), control voltage (CV), ground (GND), trigger (TRG), output (OUT), and reset (RST). The first timer 29 is connected as an oscillator for astable or free running operation. This is accomplished by connecting the DCH and THR outputs to the TRG input. The period of the pulse train produced by this astable oscillator configuration of the timer 29 is determined by the resistor 30 and the capacitor 32, which are preferably precision components so as to maintain the pulse repetition rate with accuracy notwithstanding temperature changes affecting the system. The pulse train is available at the output (OUT) terminal of the timer 29 and is indicated by the wave form shown at 33. The period, T and the duration of the pulses is constant. This first pulse train is used to trigger the second timer circuit 34 and operate it as a duty cycle modulator. The duty cycle of the pulse train produced by the timer 34 is determined the capacitance presented by the sensor. The capacitance is presented between the terminals x and y and is indicated by the capacitor shown in dash lines in FIG. 1 and indicated by the reference numeral 35. The resistance provided by a fixed resistor 36 and a variable resistor or potentiometer 37 also determines the pulse duration or duty cycle. The potentiometer 37 enables the system to be calibrated and adjusted on set-up. The duty cycle change is within the period of the pulse train, which may be considered to be a clock pulse train, which is provided from the first generator or timer 29. As the capacitance changes, the duty cycle will change because the timer 34 is connected for monostable operation with the turn off time determined by the capacitive sensor (the capacitance presented at 35) and the resistance presented by the resistor 36 and potentiometer 37. The output pulse train is indicated at 39. It will be observed that the periodicity of the pulse train is the same as the clock pulse train 33. However, the duty cycle, indicated at $T_{c1}$, $T_{c2}$ . . . varies. The duty cycle may be 50% as shown in the first half cycle by the duty cycle $T_{c1}$. As the capacitance increases due to, for example, the decrease in the layer of developer in the magnetic brush 12 in the region between the opposing surfaces of the bar 26 and the magnetic brush carrier 12, the duty cycle increases. This is shown somewhat exaggerated at $T_{c2}$ in the second cycle of the wave form 39. Accordingly, the duty cycle modulation is an effective amplification of the very small capacitance change. Preferably, the repetition rate of the pulse trains 33 and 39 is in the range between 25 and 100 KHz. This relatively high frequency contributes to making the system immune to aperiodic vibrations which occur at a much faster rate than the changes in thickness of the layer of developer. These thickness changes are reflected in a substantial change in duty cycle which is detected by integrating the output wave form from the second or duty cycle modulator timer 34. An integrator circuit 40 is provided by a resistor 42 and a capacitor 44. The connection from the magnetic brush carrier 12, indicated at y may be made to the grounded connection of the capacitor 44. Any available ground in the circuit 28 may be used.

The integrator 40 is connected to a comparator circuit 45, which is an operational amplifier, having a feedback resistor 46 to provide a hysteresis effect. The voltage at which the comparator provides an output is determined by a voltage divider consisting of two resistors 47 and 48. When the integrated, variable duty cycle pulse train 39 goes negative to an extent where the layer of developer in the magnetic brush 12 is depleted, the comparator 45 is turned on and provides an output level to a gate circuit 49. The hysteresis resistor 46 prevents the comparator from turning off until the input voltage thereto from the integrator becomes less negative than the negative voltage required to turn the comparator on. This hysteresis effect assures that the supply of developer will be initiated and terminated with a sufficient time elapse between the initiation and termination to assure that the developer is replenished to the necessary, consistent thickness. When the comparator is on an indication that developer is being supplied is provided by a light emitting diode circuit 50.

The gate circuit 49 is provided by an operational amplifier which is inhibited by the control voltage u obtained from the motor control 24. This control voltage must be a low level to enable the operational amplifier gate 49 to transmit the control voltage through a resistor 52 to the base of a power transistor 54. The power transistor 54 is operated as a saturated switch. When the transistor 54 is conducting, current flows therethrough between collector and emitter from a source of operating voltage indicated at $V_c$ across a diode 55. The terminals of the motor 20, shown at w and z, are connected across the diode. Accordingly, when current flows through the transistor 54 the voltage drop across the diode 55 is operative to cause the motor 20 to turn on. This causes the sponge roll applicator 18 to turn and supply the developer to the magnetic brush 12. When the control voltage stops the power transistor 54 is switched off and the motor 20 stops causing the supply of developer to terminate. The diode 55 commutates the reverse polarity spike from the motor on turn-off. It is desirable that no developer be supplied unless the magnetic brush is travelling. To this end the control level u from the motor control 24 is operative to inhibit the gate 49 from passing the control voltage which would turn the power transistor on. Accordingly, the buildup of a layer on the magnetic brush of developer which may be too great and might clog the gap between the opposing surfaces of the bar 26 and the magnetic brush does not occur. It is, of course, desirable that this gap between the sensor bar 26 and the brush be maintained. Nevertheless, if the gap is not maintained, the capacitance will decrease causing a substantial decrease in the duty cycle which of necessity terminates the control voltage since the direct current value of the low duty cycle pulse train 39 will be insufficient to operate the comparator 45. Thus there will not be supply of developer in the event that the sensor is clogged with developer.

Figure 3:
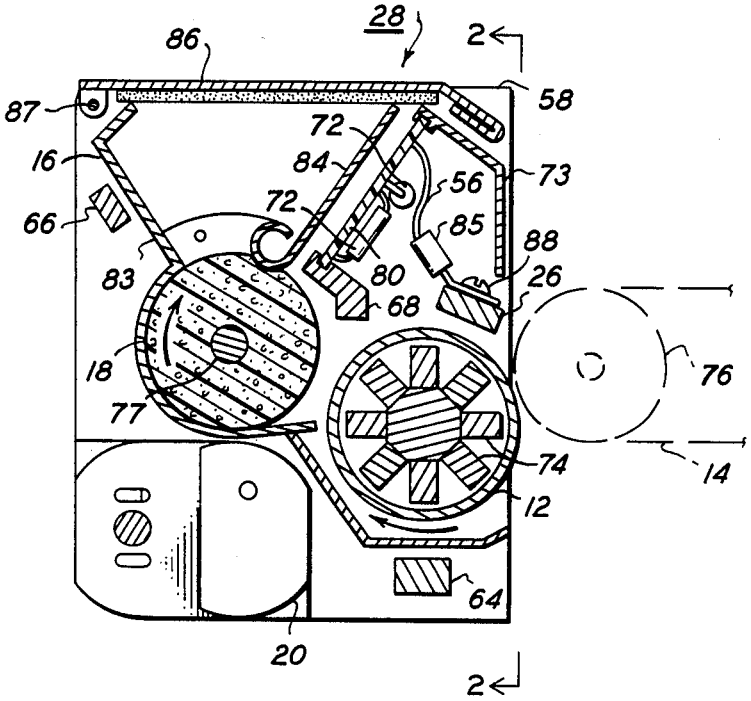
FIG. 3 is a sectional view of the developer apparatus which is taken along the line 3—3 in FIG. 2.

Referring to FIG. 3 there is shown the structure of the developer system which contains the magnetic brush 12, the hopper 16 and sponge applicator roller 18, and the circuitry 28 which is mounted on a circuit board 80 of rectangular shape. The sensing bar 26 is also a part of the developer structure and is connected to the circuitry by a lead of relatively stiff wire 56. The ground is provided by a lead connected between the board 80 and a boss on the end of the brush cylinder. The motor 20 which drives the applicator roller 18 is also part of the structure.

The structure is contained in a frame provided by side plates 58 and 60. These plates may be of nonconductive material and should be of nonconductive, insulating material at least in the vicinity of the ends of the sensing bar, which are connected to the plates as by screws 62 and 63. The side plates are also assembled together by tie rods or bars 64 and 66. A support bar 68 serves both as a tie bar to assemble the side plates 60 and 58 as well as a bracket for supporting of the circuit board 80 along the lower edge thereof by means of a groove in the bracket bar 68. The bracket bar 68 as well as the other tie bars 64 and 66 are secured to the side plates by means of screws (not shown).

The sensing bar 26 is a stiff, rigid bar. The circuit board 80 is secured so that it is disposed in the immediate proximity of the sensing bar 26 and is rigidly secured in the frame. Grooves in the side plates 58 and 60, indicated at 70 and 71, as well as the groove in the bracket bar 68 serve to secure the circuit board 80 in place. The components 72 (the integrated circuits, resistors, capacitors and the transistor and diodes) are on the side of the board which faces the sensing bar 26. Over the region of the sensing bar and circuit board is a cover 73, preferably of conductive material. This cover 73 may also be disposed in grooves or steps in the side plates 58 and 60. The upper edge of the cover 73 is in contact with the upper edge of the circuit board 80. It will be seen, therefore, that the region in which the capacitive sensing is carried out and which may be affected by its environment, is substantially enclosed and shielded. Thus, effects which might perturb the capacitance which is sensed are reduced.

The magnetic brush 12 is provided by a cylindrical shell in which an array of magnets 74 is disposed. This array is connected to a shaft 75 which is coupled to the motor 22. The photoreceptor 14 is a belt indicated in dash lines which is entrained around a roller 76 in close proximity to the cylinder which provides the carrier for the layer of developer. The tips of the brush, thus, stroke the photoreceptive belt to apply toner to the latent electrostatic image thereon. The applicator roll 18 is shown as a roll of sponge rubber or plastic material on a shaft 77. This shaft 77 is connected by gearing 78 and 82 to the motor 20 when the motor is on the shaft 77 is thus rotated.

The sponge applicator roll 18 seals the lower end of the hopper 16. The hopper is defined by metal plates 83 and 84. The plate 83 curves around the applicator roll 18. The plate 84 is curved at its lower end so as to assure that the developer material will be confined, except where the roll is disposed opposite to the magnetic brush. A cover 86 is hinged to the side plates at 87. The underside of this cover has a layer of sponge material applied thereto so as to seal the hopper 16 when the cover is closed. The cover may be pivoted upwardly to open the hopper for the addition of developer material.

The rigid sensing bar is located in very close proximity to the circuit board 80. The stiff wire 56, which may have a terminal 84 having an opening for attachment thereto to the sensing bar by means of a screw 88, also provides for a firm and rigid connection which will prevent vibrations or other mechanical perturbations from effecting the capacitance which is sensed between the bar 26 and the magnetic brush 12. The unit is very compact and may, for example, be 5 inches by 4 inches by 10 inches in size so as to be adapted for use in compact copiers.

From the foregoing description, it will be apparent that there has been provided an improved method and apparatus for controlling the application of developer material in electrostatic reproduction. While a preferred embodiment of the apparatus and a preferred mode of practicing the invention has been described, variations and modifications therein, within the scope of the invention, will undoubtedly suggest themselves to those skilled in the art. Accordingly, the foregoing description should be taken as illustrative and not in a limiting sense.

I claim:

1. The method of controlling the thickness of monocomponent developer material on a magnetic brush operative to transfer said material to a photoreceptor to develop an image thereon, said method comprising the steps of sensing the dielectric constant presented by the amount of said material in a region adjacent to said brush, converting said dielectric constant into a repetitive electric pulse waveform, the duty cycle of which correspond to said dielectric constant to provide an electrical control signal, and controlling the dispensing of said developer material on to said brush with said control signal.

2. The method according to claim 1 wherein said sensing steps includes the steps of detecting changes in capacitance proportional to the dielectric constant in said region, and converting said capacitance changes into changes in said duty cycle.

3. The method according to claim 2 wherein said sensing step includes the step of defining said region with the aid of a conductive member having a surface facing said brush and out of contact with said developer material thereon.

4. The method according to claim 3 further comprising the step of preventing aperiodic vibration of said conductive member.

5. The method according to claim 2 wherein said converting step is carried out by generating a first periodic pulse train, generating a second periodic pulse train the pulses of which occur synchronously with the pulses of said first pulse train, and varying the duration of the pulses of said second pulse train in accordance with said changes in capacitance, and translating said pulse train into said control signal.

6. The method according to claim 5 wherein said controlling step is carried out by initiating and terminating the dispensing of said developer material respectively when said control signal reaches a first level and then reaches a second level, said first and second levels differing from each other to define a hysteresis characteristic.

7. The method according to claim 4 wherein said step of preventing aperiodic vibration of said member comprises rigidly mounting said member, and converting said capacitance and generating said control signal with the aid of circuits rigidly mounted closely adjacent to said member.

8. The method according to claim 6 further comprising the step of inhibiting the dispensing of said developer even when said control signal reaches said first level in the absence of movement of said brush.

9. Apparatus for controlling the thickness of a layer of developer material on a carrier from which the material is transferred onto an electrostatic image bearing surface which comprises means for sensing the dielectric constant in a region adjacent to said carrier which includes a portion of said layer, means responsive to said sensing means for generating a chain of repetitive pulses the duty cycle of which corresponds to said dielectric constant, and means for supplying developer material to said carrier responsive to said train of pulses.

10. The apparatus according to claim 9 where said developer is a monocomponent developer and said carrier is a magnetic brush having means for causing said developer to travel between a first location where said material is supplied to said carrier to a second location where said developer is transferred to said image bearing surface, said region being disposed along the path of travel of said brush between said first and second locations.

11. The apparatus according to claim 10 wherein said brush is provided by a cylinder of nonmagnetic material the surface of which defines said carrier on which said layer is disposed, a bar of conductive material generally paralleling the axis of said cylinder and spaced radially away from said cylinder surface a distance sufficient to be out of contact with said layer, the surface of said bar and the surface of said cylinder defining said region.

12. The apparatus according to claim 11 wherein said bar is of sufficient thickness for its length to be rigid.

13. The apparatus according to claim 12 further comprising a frame having sides, said magnetic brush being disposed in said frame between said sides, said bar also being disposed in said frame between said sides, a rectangular circuit board having components mounted thereon with connections therebetween to define said generating means, said board having a length substantially equal to the length of said bar, means on said sides and extending therebetween for mounting said circuit board in said frame with said bar and boards lengthwise being in parallel relationship and with a side of said board facing said bar and said cylinder, and an electrical wire connecting said bar and said board.

14. The apparatus according to claim 13 further comprising a cover member of conductive material on said frame generally enclosing a section therein defined by said board, said cylinder and said bar.

15. The apparatus according to claim 13 wherein said supplying means comprises an applicator roll rotatably mounted between said sides and disposed adjacent to said cylinder, means of said frame closed at one end by said roll and defining a hopper for said developer material, and means for driving said roll for carrying said developer material from said hopper into the vicinity of said magnetic brush cylinder for transfer of said developer material to said magnetic brush.

16. The apparatus according to claim 15 wherein said driving means is an electrical motor mounted in said frame and coupled in driving relationship with said applicator roll.

17. The apparatus according to claim 9 wherein said sensing means includes a conductive member spaced from said carrier to define said region and present a capacitance corresponding to said dielectric constant in said region thereby defining a capacitive sensor.

18. The apparatus according to claim 9 wherein said generating means comprises astable circuit means for generating a first train of repetitive pulses having a certain repetition rate, and monostable circuit means for generating a second train of pulses synchronously with said first train, said capacitive sensor being connected to said monostable circuit means for controlling the duty cycle of said pulses in said second train.

19. The apparatus according to claim 18 wherein said astable circuit means is a first RC timer circuit having trigger, discharge and threshold inputs and an output, and said monostable circuit means is a second RC timer circuit having trigger, discharge and threshold inputs and an output, a fixed RC circuit connected to said discharge and threshold inputs of said first timer circuit, and said discharge and threshold inputs of said first timer circuit being connected to the trigger input thereof to define said astable oscillator which generates said first pulse train, the output of said first timer being connected to the trigger input of said second timer and said capacitive sensor and a resistor being connected to the discharge and threshold inputs of said second timer to define a monostable oscillator for generating at said output thereof said second pulse train with the duty cycle thereof corresponding to the capacitance presented by said sensor.

20. The apparatus according to claim 9 further comprising means for providing a control voltage corresponding to the duty cycle of said pulse train, and means for initiating and terminating the supplying of said developer when said control voltage reaches a first level and then changes from said first level to a second level whereby to provide a hysteresis characteristic.

21. The apparatus according to claim 9 wherein said supplying means further comprises means for integrating said pulse train, a comparator responsive to said integrated pulse train for detecting when said integrated pulse train exceeds a certain level for providing a control signal, and means for dispensing said developer material upon occurrence of said control signal.

22. The apparatus according to claim 21 further comprising gate means for inhibiting the application of said control signal to said dispensing means when said carrier is inoperative to transfer said material to said image bearing surface.

23. In developer apparatus for use in an electrostatic copier which comprises a frame having sides, a magnetic brush mounted in said sides, a hopper for developer material, an applicator closing said hopper for delivering said material to said magnetic brush, improved sensor apparatus for detecting the thickness of the developer material on said brush which comprises a rigid, stiff capacitive sensor bar disposed adjacent to a portion of the surface of said magnetic brush and extending longitudinally along said brush, a circuit board connected to said sensor bar, means in said side frame for receiving and supporting the edges of said board to define a section of said frame containing said sensing bar, and defined by the surface of said magnetic brush and said board.

24. The invention according to claim 23 wherein said improved sensor apparatus further comprises a cover of conductive material substantially enclosing said section of said frame.

* * * * *